US007018964B2

(12) United States Patent
Maeno et al.

(10) Patent No.: US 7,018,964 B2
(45) Date of Patent: Mar. 28, 2006

(54) DETERGENT COMPOSITION

(75) Inventors: Junichi Maeno, Osaka (JP); Shugo Kawakami, Osaka (JP); Kazutaka Zenfuku, Osaka (JP)

(73) Assignee: Arakawa Chemical Industries, Ltd., Osaka (JP)

( * ) Notice: Subject to any disclaimer, the term of this patent is extended or adjusted under 35 U.S.C. 154(b) by 330 days.

(21) Appl. No.: 10/240,608

(22) PCT Filed: Dec. 28, 2001

(86) PCT No.: PCT/JP01/11618

§ 371 (c)(1),
(2), (4) Date: Sep. 30, 2002

(87) PCT Pub. No.: WO02/055645

PCT Pub. Date: Jul. 18, 2002

(65) Prior Publication Data

US 2003/0181349 A1 Sep. 25, 2003

(30) Foreign Application Priority Data

Jan. 5, 2001 (JP) ..... 2001-000303

(51) Int. Cl.

| | |
|---|---|
| ***C11D 1/72*** | (2006.01) |
| ***C11D 3/26*** | (2006.01) |
| ***C11D 3/36*** | (2006.01) |
| ***C11D 3/43*** | (2006.01) |

(52) U.S. Cl. ..... 510/175; 510/176; 510/245; 510/265; 510/423; 510/433; 510/467; 510/499; 510/500; 510/506

(58) Field of Classification Search ..... 510/175, 510/176, 245, 265, 423, 433, 467, 499, 500, 510/506

See application file for complete search history.

(56) References Cited

U.S. PATENT DOCUMENTS

| | | | | |
|---|---|---|---|---|
| 3,673,099 | A | 6/1972 | Corby et al. | |
| 4,428,871 | A | 1/1984 | Ward | |
| 4,664,721 | A | 5/1987 | Valasek | |
| 4,744,834 | A | 5/1988 | Haq | |
| 4,812,255 | A | 3/1989 | Suwala | |
| 4,836,950 | A | 6/1989 | Madsen | |
| 5,006,279 | A | 4/1991 | Grobbel | |
| 5,024,780 | A | 6/1991 | Leys | |
| 5,756,443 | A * | 5/1998 | Inoue et al. | 510/238 |
| 5,798,323 | A * | 8/1998 | Honda et al. | 510/176 |
| 6,103,680 | A * | 8/2000 | Honda et al. | 510/178 |
| 6,140,027 | A * | 10/2000 | Baik et al. | 430/331 |

FOREIGN PATENT DOCUMENTS

| | | |
|---|---|---|
| EP | 0 389 829 | 3/1990 |
| EP | 0 442 271 | 1/1991 |
| EP | 0 698 660 A | 2/1996 |
| JP | 61-091299 | 5/1986 |
| JP | 62-256897 | 11/1987 |
| JP | 62-257994 | 11/1987 |
| JP | 63-050838 | 3/1988 |
| JP | 04/034000 | 2/1992 |
| JP | 05/40000 | 6/1993 |
| JP | 06-287596 | 10/1994 |
| JP | 06-330087 | 11/1994 |
| JP | 08-073893 | 3/1996 |
| JP | 09-311467 A | 12/1997 |
| JP | 10-310795 | 11/1998 |
| JP | 2001-232647 | 8/2001 |
| JP | 2001-355000 | 12/2001 |
| WO | WO 93/16160 | 8/1993 |

* cited by examiner

*Primary Examiner*—Gregory R. Del Cotto
(74) *Attorney, Agent, or Firm*—Knobbe Martens Olson & Bear, LLP

(57) ABSTRACT

The cleaning composition of this invention comprises, as effective components, a compound (A) represented by the formula (1) and a nonionic surfactant (B):

(1)

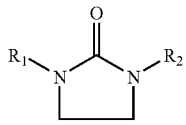

wherein $R_1$ represents a hydrogen atom or a straight-chain or branched-chain alkyl group having 1 to 5 carbon atoms and $R_2$ represents a hydrogen atom or a straight-chain or branched-chain alkyl group having 1 to 5 carbon atoms. The cleaning composition of the invention is excellent in detergency and is satisfactory in respect of environmental protection properties, odor and flammability. An article to be cleaned can be cleaned by coming into contact with this cleaning composition.

11 Claims, No Drawings

DETERGENT COMPOSITION

This application is the U.S. National Phase under 35 U.S.C. §371 of International Application PCT/JP01/11618, filed Dec. 28, 2001, which claims priority to Japanese Patent Application No. 2001/303, filed Jan. 5, 2001. The International Application was not published under PCT Article 21(2) in English.

FIELD OF THE INVENTION

The present invention relates to a cleaning composition and more particularly to a cleaning composition for use in removing a solder flux used in the preparation of flip chip devices and containing a thickener and a thixotropic agent in large amounts and for use in degreasing or cleaning metal parts, ceramic parts and the like, and to a method of using the cleaning composition.

BACKGROUND ART

In the prior art, hydrocarbon halide such as trichloroethylene and trichlorotrifluoroethane have been used as an industrial detergent. However, such detergent can not be used today due to a problem of environmental pollution including the destruction of ozone layer.

In view of such a situation, the present applicant developed a halogen-free cleaning composition essentially containing a specific glycol ether compound, a nonionic surfactant and a polyoxyalkylenephosphoric ester surfactant (Japanese Patent No.1832450). A variety of halogen-free detergents heretofore developed contain an ionic surfactant and the like in general and are superior in detergency and in alleviating problems of toxicity, odor, flammability and influence on an article to be cleaned.

With a recent increase in small-size and large-capacity articles to be cleaned, flip chip devices have been increasingly used. Consequently, to finely control the position of parts on the substrate, solder fluxes containing large amounts of additives such as a thickener and a thixotropic agent have grown into use. In this situation, now more excellent detergency is required.

When processed metal parts and ceramic parts are cleaned, there are needs for effectively eliminating particles, grindstone particles, ion components and the like by cleaning in addition to conventional degreasing of processing oils; the above halogen-free detergent may be unsatisfactory in fulfilling the needs.

Halogen-free detergents recently developed are used as follows. After cleaning the article with the halogen-free detergent, the article is subjected to a water-rinsing treatment (generally comprising a step of pre-rinsing the article for removal of dirt components and a succeeding step of finish-rinsing the article for removal of the detergent components), whereby the article can be cleaned to achieve a high extent of cleanliness.

However, when the rinsing water is repeatedly used in such water-rinsing treatment, the rinsing water is thickened with the cleaning components (chiefly an ionic surfactant) and is thereby made alkaline or acidic, so that the materials of article to be cleaned may partly discolor and/or corrode. The discoloration and corrosion of the materials occur at the water-rinsing treatment, especially at the pre-rinsing step for removing the dirt components from the article. For example, a thick coating of glass used in a hybrid IC for vehicles or for communications causes bluing in an acidic aqueous solution and becomes partly dissolved and turned white in an alkaline aqueous solution. Furthermore, the acid or alkali corrodes or discolors portions of metals such as nickel, brass, solder or the like of the surface of the article to be cleaned.

DISCLOSURE OF THE INVENTION

An object of the invention is to provide a cleaning composition which is excellent in detergency and which is substantially satisfactory in respect of properties for environmental protection, reduction in odor and flammability, etc.

The present inventors conducted extensive research to achieve the object and found that a cleaning composition given below is excellent in detergency and is satisfactory in respect of properties for environmental protection, lowered odor and flammability, etc.

A cleaning composition comprising, as effective components, a compound (A) represented by the formula (1) and a nonionic surfactant (B):

(1)

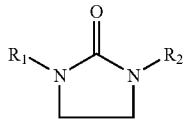

wherein $R_1$ represents a hydrogen atom or a straight-chain or branched-chain alkyl group having 1 to 5 carbon atoms and $R_2$ represents a hydrogen atom or a straight-chain or branched-chain alkyl group having 1 to 5 carbon atoms.

The present invention was completed after making further investigations based on the above novel finding and provides the following cleaning compositions and method of cleaning an article to be cleaned and the like.

1. A cleaning composition comprising, as effective components, a compound (A) represented by the formula (1) and a nonionic surfactant (B):

(1)

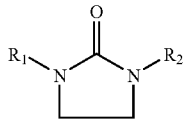

wherein $R_1$ represents a hydrogen atom or a straight-chain or branched-chain alkyl group having 1 to 5 carbon atoms and $R_2$ represents a hydrogen atom or a straight-chain or branched-chain alkyl group having 1 to 5 carbon atoms.

2. The cleaning composition according to item 1, wherein the nonionic surfactant (B) is a polyethylene glycol ether type nonionic surfactant represented by the formula (2)

$$R_3—O—(CH_2—CH_2—O)_m—H \quad (2)$$

wherein $R_3$ represents a straight-chain or branched-chain alkyl group having 6 to 20 carbon atoms, a phenyl group or a phenyl group substituted with a straight-chain or branched-chain alkyl group having 7 to 12 carbon atoms and m represents an integer of 2 to 20.

3. A cleaning composition comprising a compound (A) represented by the formula (1), a nonionic surfactant (B), a polyoxyalkylenephosphoric ester surfactant (C) and a polyoxyalkyleneamine surfactant (D):

(1)

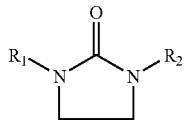

wherein $R_1$ represents a hydrogen atom or a straight-chain or branched-chain alkyl group having 1 to 5 carbon atoms and $R_2$ represents a hydrogen atom or a straight-chain or branched-chain alkyl group having 1 to 5 carbon atoms.

4. The cleaning composition according to item 3, wherein the nonionic surfactant (B) is a polyethylene glycol ether type nonionic surfactant represented by the formula (2)

$$R_3—O—(CH_2—CH_2—O)_m—H \quad (2)$$

wherein $R_3$ represents a straight-chain or branched-chain alkyl group having 6 to 20 carbon atoms, a phenyl group or a phenyl group substituted with a straight-chain or branched-chain alkyl group having 7 to 12 carbon atoms and m represents an integer of 2 to 20.

5. The cleaning composition according to item 3 or 4, wherein the polyoxyalkylenephosphoric ester surfactant (C) is a polyoxyethylenephosphoric ester surfactant represented by the formula (3) or a salt thereof:

(3)

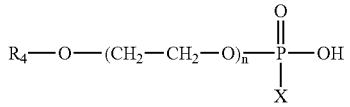

wherein $R_4$ represents a straight-chain or branched-chain alkyl group having 5 to 20 carbon atoms, a phenyl group or a phenyl group substituted with a straight-chain or branched-chain alkyl group having 7 to 12 carbon atoms, n represents an integer of 0 to 20 and X represents a hydroxyl group or a group represented by the formula (4)

$$R_5—O(CH_2—CH_2—O)_n— \quad (4)$$

wherein $R_5$ represents a straight-chain or branched-chain alkyl group having 5 to 20 carbon atoms, a phenyl group or a phenyl group substituted with a straight-chain or branched-chain alkyl group having 7 to 12 carbon atoms, and n represents an integer of 0 to 20.

6. The cleaning composition according to item 3, 4 or 5, wherein the polyoxyalkyleneamine surfactant (D) is a polyoxyethyleneamine surfactant represented by the formula (5)

(5)

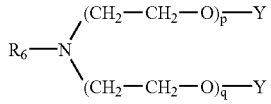

wherein $R_6$ represents a hydrogen atom or a straight-chain or branched-chain alkyl group having 1 to 22 carbon atoms or a straight-chain or branched-chain alkenyl group having 2 to 22 carbon atoms, Y represents a hydrogen atom or a straight-chain or branched-chain alkyl group having 1 to 4 carbon atoms or a straight-chain or branched-chain acyl group having 1 to 4 carbon atoms, p represents an integer of 1 to 15 and q represents an integer of 0 to 15.

7. The cleaning composition according to any one of items 3 to 6 which comprises 0.1 to 97% by weight of the compound (A), 0.1 to 97% by weight of the nonionic surfactant (B), 0.01 to 85% by weight of the polyoxyalkylenephosphoric ester surfactant (C) and 0.01 to 85% by weight of the polyoxyalkyleneamine surfactant (D).

8. The cleaning composition according to any one of items 1 to 7 which further contains a compound (E) represented by the formula (6)

(6)

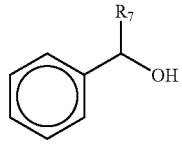

wherein $R_7$ represents a hydrogen atom or a straight-chain or branched-chain alkyl group having 1 to 5 carbon atoms.

9. The cleaning composition according to any one of items 1 to 8 which further contains water.

10. The cleaning composition according to any one of items 1 to 9 which is used for cleaning flip chip devices.

11. A method of cleaning an article to be cleaned, the method comprising the step of bringing the cleaning composition of any one of items 1 to 9 into contact with the article to be cleaned.

12. Use of a composition as a detergent which comprises a mixture of a compound (A) represented by the formula (1) and a nonionic surfactant (B):

(1)

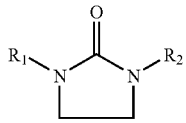

wherein $R_1$ represents a hydrogen atom or a straight-chain or branched-chain alkyl group having 1 to 5 carbon atoms and $R_2$ represents a hydrogen atom or a straight-chain or branched-chain alkyl group having 1 to 5 carbon atoms.

13. Use of the cleaning composition according to any one of items 1 to 9, as a detergent.

DETAILED DESCRIPTION OF THE INVENTION

1) Basic Composition

The cleaning composition of the invention comprises, as effective components, a compound (A) represented by the formula (1) and a nonionic surfactant (B):

(1)

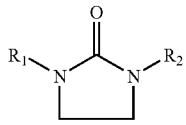

wherein $R_1$ represents a hydrogen atom or a straight-chain or branched-chain alkyl group having 1 to 5 carbon atoms and $R_2$ represents a hydrogen atom or a straight-chain or branched-chain alkyl group having 1 to 5 carbon atoms.

2) Compound (A)

The compound (A) achieves a main aim of a detergent of dissolving the dirt components. Examples of the compound (A) represented by the formula (1) are 2-imidazolidone, 1,3-dimethyl-2-imidazolidinone, 1,3-diethyl-2-imidazolidinone, 1,3-dipropyl-2-imidazolidinone, 1,3-dibutyl-2-imidazolidinone, 1,3-dipentyl-2-imidazolidinone, 1,3-diisopropyl-2-imidazolidinone, 1-isopropyl-2-imidazolidinone, 1-isobutyl-2-imidazolidinone, 1-isopentyl-2-imidazolidinone, 1-methyl-2-imidazolidinone, 1-ethyl-2-imidazolidinone, 1-propyl-2-imidazolidinone, 1-butyl-2-imidazolidinone, 1-pentyl-2-imidazolidinone, 1-methyl-3-ethyl-2-imidazolidinone, 1-methyl-3-propyl-2-imidazolidinone, 1-methyl-3-butyl-2-imidazolidinone, 1-methyl-3-pentyl-2-imidazolidinone, 1-ethyl-3-propyl-2-imidazolidinone and 1-ethyl-3-butyl-2-imidazolidinone. These compounds can be used either alone or in a suitable combination. Among the compounds of the formula (1), preferred compound are those wherein $R_1$ and $R_2$ are the same or different and each represent an alkyl group having 1 to 3 carbon atoms in order to retain the solubility in water of the cleaning composition and to attain a good water rinsability. Among these preferred compounds, 1,3-dimethyl-2-imidazolidinone, 1,3-diethyl-2-imidazolidinone and 1,3-dipropyl-2-imidazolidinone are more preferable because of their high detergency.

3) Surfactant (B)

The nonionic surfactant (B) is capable of retaining the dirt components in water while the article to be cleaned is rinsed. There is no limitation on the nonionic surfactant (B) insofar as it is nonionic. A wide variety of known nonionic surfactants can be used as the surfactant (B). Specific examples of the surfactant (B) are polyoxyalkylenealkyl (an alkyl group having 6 or more carbon atoms) ether, polyoxyalkylenephenyl ether, polyoxyalkylenealkyl phenyl ether and like polyoxyalkylene glycol ether type nonionic surfactants; polyalkylene glycol monoester, polyalkylene glycol diester and like polyalkylene glycol ester type nonionic surfactants; alkylene oxide adducts of fatty acid amide; sorbitan fatty acid ester, sucrose fatty acid ester and like polyhydric alcohol nonionic surfactants; fatty acid alkanol amide and the like. These nonionic surfactants (B) can be used either alone or in a suitable combination.

The term "alkylene" used herein refers to ethylene, propylene or butylene. The term "polyoxyalkylene" used herein refers to polyoxyethylene, polyoxypropylene, polyoxybutylene and a copolymer of at least two of ethylene oxide, propylene oxide and butylene oxide.

Among these examples of the nonionic surfactant (B), a polyalkylene glycol ether type nonionic surfactant is preferable in view of its detergency. Among them, more preferable are polyethylene glycol ether type nonionic surfactants among which polyoxyethylenealkyl ether represented by the formula (2) is more preferable:

$$R_3—O—(CH_2—CH_2—O)_m—H \quad (2)$$

wherein $R_3$ represents a straight-chain or branched-chain alkyl group having 6 to 20 carbon atoms, a phenyl group or a phenyl group substituted with a straight-chain or branched-chain alkyl group having 7 to 12 carbon atoms and m represents an integer of 2 to 20. Preferred group of $R_3$ is a straight-chain or branched-chain alkyl group having 6 to 20 carbon atoms, and more preferred group of $R_3$ is a straight-chain or branched-chain alkyl group having 10 to 16 carbon atoms. In the formula (2), m is preferably an integer of 3 to 16.

4) Surfactant (C) and Surfactant (D)

The cleaning composition of the invention may contain a polyoxyalkylenephosphoric ester surfactant (C) and a polyoxyalkyleneamine surfactant (D) in addition to the compound (A) represented by the formula (1) and the nonionic surfactant (B). The cleaning composition of the invention containing the polyoxyalkylenephosphoric ester surfactant (C) exhibits greatly improved detergency when diluted with water. However, if the polyoxyalkylenephosphoric ester surfactant (C) is contained in the cleaning composition, the rinsing water is made acidic, and the article to be cleaned is liable to discolor although depending on the article to be cleaned. To prevent this problem, the polyoxyalkyleneamine surfactant (D) is preferably added as a pH adjuster.

Various known surfactants can be used as the polyoxyalkylenephosphoric ester surfactant (C) without limitation. Such known polyoxyalkylenephosphoric ester surfactants include, for example, "PLYSURF" series (trade name, manufactured by Dai-ichi Kogyo Seiyaku Co., Ltd.).

In view of detergency, properties for environmental protection and low flammability, it is preferred to use a polyoxyethylenephosphoric ester surfactant represented by the formula (3) or a salt thereof:

$$R_4—O—(CH_2—CH_2—O)_n—\overset{\overset{\displaystyle O}{\|}}{\underset{\underset{\displaystyle X}{|}}{P}}—OH \quad (3)$$

wherein $R_4$ represents a straight-chain or branched-chain alkyl group having 5 to 20 carbon atoms, a phenyl group or a phenyl group substituted with a straight-chain or branched-chain alkyl group having 7 to 12 carbon atoms, n represents an integer of 0 to 20 and X represents a hydroxyl group or a group represented by the formula (4)

$$R_5—O(CH_2—CH_2—O)_n— \quad (4)$$

wherein $R_5$ represents a straight-chain or branched-chain alkyl group having 5 to 20 carbon atoms, a phenyl group or a phenyl group substituted with a straight-chain or branched-chain alkyl group having 7 to 12 carbon atoms, and n represents an integer of 0 to 20. Examples of the salts are sodium salts, potassium salts and like metal salts, ammonium salts and alkanolamine salts having 1 to 20 carbon atoms.

Preferred group of $R_4$ in the formula (3) is a straight-chain or branched-chain alkyl group having 5 to 20 carbon atoms, and more preferred group of $R_4$ is a straight-chain or branched-chain alkyl group having 7 to 16 carbon atoms. In the formula (3), n is preferably an integer of 3 to 16. When X is a substituent represented by the formula (4), $R_5$ is preferably an alkyl group and more preferably an alkyl group having 6 to 16 carbon atoms. In the formula (4), n is more preferably an integer of 1 to 8.

These polyoxyalkylenephosphoric ester surfactants (C) can be used either alone or in a suitable combination.

The polyoxyethylenephosphoric ester surfactants of the formula (3) or salts thereof are commercially available, for example, under trade names "PLYSURF" series (manufactured by Dai-ichi Kogyo Seiyaku Co., Ltd.), and "N-1000 FCP", "RA-574" and "RA-579" (manufactured by Nippon Nyukazai Co., Ltd.).

The polyoxyalkyleneamine surfactants (D) are limitless and include various known surfactants, such as "ETHOMEEN" (trade name, manufactured by LION Corp.). From the viewpoints of detergency, properties for environmental protection and suppressed flammability, preferred examples of the polyoxyalkyleneamine surfactants (D) are polyoxyethyleneamine surfactants represented by the formula (5)

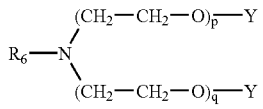

(5)

wherein $R_6$ represents a hydrogen atom or a straight-chain or branched-chain alkyl group having 1 to 22 carbon atoms or a straight-chain or branched-chain alkenyl group having 2 to 22 carbon atoms, Y represents a hydrogen atom or a straight-chain or branched-chain alkyl group having 1 to 4 carbon atoms or a straight-chain or branched-chain acyl group having 1 to 4 carbon atoms, p represents an integer of 1 to 15 and q represents an integer of 0 to 15.

Preferred group of $R_6$ is a straight-chain or branched-chain alkyl group or alkenyl group having 8 to 18 carbon atoms, and more preferred group of $R_6$ is a straight-chain or branched-chain alkyl group or alkenyl group having 14 to 18 carbon atoms. Y is preferably a hydrogen atom. Preferably, the sum of p and q is an integer of 2 to 15.

These polyoxyalkyleneamine surfactants (D) can be used either alone or in a suitable combination.

The polyoxyethylenealkylamine surfactants represented by the formula (5) are commercially available, for example, under trade names "Newcol 405" and "Newcol 410" (both manufactured by Nippon Nyukazai Co., Ltd.), "Pionin D-3104" and "Pionin D-3110" (both manufactured by Takemoto OIL&FAT Co. Ltd.), and "ETHOMEEN T/15", "ETHOMEEN T/25" (both manufactured by LION Corp.), etc.

5) Compound (E)

The cleaning composition of the present invention may contain a compound (E) represented by the formula (6)

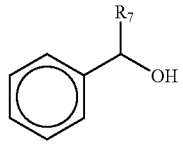

(6)

wherein $R_7$ represents a hydrogen atom or a straight-chain or branched-chain alkyl group having 1 to 5 carbon atoms in order to increase the foam breakability.

Examples of the compounds (E) are benzyl alcohol, 1-phenylethanol, 1-phenylpropanol, 1-phenylbutanol, 1-phenylpentanol, 1-phenylhexanol, 1-phenyl-3-methylbutanol, 1-phenyl-3-methylpentanol, 1-phenyl-4-methylpentanol, 1-phenyl-2-methylpentanol, 1-phenyl-2,3-dimethylpentanol, 1-phenyl-2,2-dimethylpentanol, 1-phenyl-2-methylpropanol, 1-phenyl-2-methylbutanol, 1-phenyl-3,3-dimethylbutanol, 1-phenyl-2,2-dimethylpropanol, etc. These compounds can be used either alone or in a suitable combination. Among the compounds represented by the formula (6), preferred are benzyl alcohol, 1-phenylethanol, 1-phenylpropanol, 1-phenylbutanol, 1-phenylpentanol, 1-phenylhexanol and the like for their high foam breakability. Among them, benzyl alcohol is more preferred.

6) Proportions of Components

The proportions of the compound (A) and the nonionic surfactant (B) to be used are not limited but are preferably about 0.1 to about 97% by weight of the compound (A) and about 0.1 to about 97% by weight of the nonionic surfactant (B), more preferably about 0.5 to about 80% by weight of the compound (A) and about 0.5 to about 80% by weight of the nonionic surfactant (B).

For increase in the detergency of the cleaning composition diluted with water, about 0.01 to about 85% by weight, preferably 0.1 to about 60% by weight, of each of the polyoxyalkylenephosphoric ester surfactant (C) and the polyoxyalkylenealkylamine surfactant (D) may be incorporated to provide the cleaning composition of the invention comprising the compound (A), the nonionic surfactant (B), the polyoxyalkylenephosphoric ester surfactant (C) and the polyoxyalkylenealkylamine surfactant (D).

For improving the foam breakability and the like of the cleaning composition, about 85% by weight or less, preferably not less than about 10% by weight and not more than about 80% by weight, of the compound (E) represented by the formula (6) can be added to provide the cleaning composition of the invention comprising the compound (A), the nonionic surfactant (B), the polyoxyalkylenephosphoric ester surfactant (C), the polyoxyalkylenealkylamine surfactant (D) and the compound (E).

The proportions of the components will be described below.

6-1) Compound A

As described above, the compound (A) achieves an essential effect of a detergent of dissolving the dirt components. Although the required amount of the compound (A) varies depending on the kind of an article to be cleaned (kind of contaminants) and on the cleaning method, the compound (A) needs to be contained in an amount of at least 0.1% by weight based on the cleaning composition. Usually the amount of the compound (A) to be contained is about 0.1 to about 97% by weight, preferably about 0.5 to about 80% by weight, based on the cleaning composition. When the amount of the compound (A) to be used is 65% by weight or more, high cleanliness is achieved irrespectively of the kind of an article to be cleaned and the cleaning method.

6-2) Surfactant (B)

As described above, the nonionic surfactant (B) is capable of retaining the dirt components in water when rinsing the article to be cleaned. Although the necessary amount of the surfactant (B) is variable depending on the kind of an article to be cleaned (kind of contamination) and on the cleaning method, the nonionic surfactant (B) needs to be contained in the cleaning composition in an amount of at least 0.1% by weight based on the cleaning composition. Usually the amount of the nonionic surfactant (B) to be contained is about 0.1 to about 97% by weight, preferably about 0.5 to about 80% by weight, based on the cleaning composition. When the amount of the nonionic surfactant (B) to be used is 4% by weight or more, excellent detergency is exhibited irrespectively of the kind of an article to be cleaned and the cleaning method.

6-3) Surfactant (C)

The polyoxyalkylenephosphoric ester surfactant (C) increases the detergency especially when the detergent is used as diluted with water. The polyoxyalkylenephosphoric ester surfactant (C), when incorporated into the cleaning composition of the invention, needs to be contained in an amount of at least 0.01% by weight based on the cleaning composition. Usually the amount of the polyoxyalkylenephosphoric ester surfactant (C) to be contained is about 0.01 to about 85% by weight, preferably about 0.1 to about 60% by weight, based on the cleaning composition. When the amount of the surfactant (C) to be contained exceeds 85% by weight, a higher effect is not achieved and what is worse, the article to be cleaned may corrode.

6-4) Surfactant (D)

The polyoxyalkyleneamine surfactant (D) increases the detergency especially when the detergent is used as diluted with water. Therefore, the polyoxyalkyleneamine surfactant (D), when incorporated into the cleaning composition of the invention, needs to be contained in an amount of at least 0.01% by weight based on the cleaning composition. Usually the amount of the polyoxyalkylenealkylamine surfactant (D) to be contained is about 0.01 to about 85% by weight, preferably about 0.1 to about 60% by weight, based on the cleaning composition. When the amount of the surfactant (D) to be contained exceeds 85% by weight, a higher effect is not achieved and what is worse, the article to be cleaned may corrode.

6-5) Compound (E)

The compound (E), when incorporated into the cleaning composition of the invention, needs to be contained usually in an amount of 85% by weight or less, more preferably in an amount between about 10% by weight and about 80% by weight, based on the cleaning composition.

7) Form of Aqueous Solution

The cleaning composition of the invention can be used as such or as dissolved in water, i.e. as an aqueous solution although depending on the kind of an article to be cleaned (kind of contaminants) or on the cleaning method. The cleaning composition in the form of an aqueous solution can reduce the risk of ignition and can lower the load of disposal of waste water.

From a viewpoint of excellent detergency, the cleaning composition is preferably used in the form of an aqueous solution in a concentration of about 70 to about 98% by weight irrespectively of the formulations or compositions to be employed. Thereby high detergency is achieved in removing the solder flux containing a thixotropic agent and a thickener in large amounts. When metal parts or ceramic parts are cleaned for removal of processing oil or when particles are eliminated, an effect is given even if the effective ingredients (compound (A) and nonionic surfactant (B)) are used in a concentration of about 1% by weight.

It is preferred to adjust the proportions of components in the cleaning composition of the invention in the form of an aqueous solution containing the effective ingredients in a concentration of 1% by weight so that the pH is brought to a neutral range of about 6 to about 8. By adjusting the pH to the neutral range of about 6 to about 8, the change of pH which will be accompanied by thickening the rinsing water with the ionic surfactant can be suppressed even if the rinsing water is repeatedly used in the water-rinsing treatment (pre-rinsing tank), whereby the corrosion and discoloration of articles to be cleaned can be prevented.

The pH of the cleaning composition of the invention can be controlled chiefly by the proportions of the anionic polyoxyalkylenephosphoric ester surfactant (C) and the cationic polyoxyalkyleneamine surfactant (D). Accordingly, the pH can be adjusted by properly varying the proportions thereof. The pH of the cleaning composition, although different depending on the kind of surfactants to be used, may be the pH which is attained by the polyoxyalkyleneamine surfactant (D) and the polyoxyalklenephophoric ester surfactant (C) at a weight ratio ranging from about 0.1-about 10 to 1 of the former to the latter, preferably from about 0.2-about 5 to 1 of the former to the latter.

Various effects such as etching effects may be expected by adjusting the pH to an acidic or alkaline range in an aqueous solution of the cleaning composition containing the effective ingredients in a concentration of 1% by weight although depending on the article to be cleaned. Thus, the cleaning composition of the invention is not limited to one in which an aqueous solutions in a concentration of 1% by weight would exhibit a pH in a neutral range.

8) Additive

The cleaning composition of the present invention may contain additives such as an antifoamer, antioxidant and the like when so required. The additive is used in an amount of about 0.1% by weight or less based on the cleaning composition.

9) Article to be Cleaned

The cleaning composition of the present invention shows high detergency in cleaning various processed metal parts, ceramic parts, electronic parts and the like. The cleaning composition of the present invention shows remarkable detergency compared with known glycol ether detergent, especially when used for cleaning flip chip devices having thereon large amounts of residual thixotropic agent, thickener and the like, such as PGA, BGA, CSP and MCM, and particularly a wafer level CSP produced by a printing method using a solder paste, interposer and the like.

10) Method of Use

Various methods can be employed for cleaning an article to be cleaned with the cleaning composition of the invention. Described below are methods to be generally carried out in which an electronic part (especially an electronic part having thereon rosin flux residue) is cleaned by bringing the cleaning composition of the invention into contact with the electronic part. In more detail, a suitable method is selected from a wide variety of methods such as a method wherein an electronic part is cleaned by directly immersing the part in the cleaning composition; a method wherein an electronic part is flushed with an aqueous solution of the cleaning composition by a spray device; a method wherein an electronic part is brushed by mechanical means, etc. When a flip chip device is cleaned, a detergent must be passed through an interstice of 50 μm or less. Consequently, it is the most suitable to clean the substrate with Direct Pass cleaning machine (trade name, product of ARAKAWA CHEMICAL INDUSTRIES. Ltd., Japanese Pat. No.2621800).

The conditions for cleaning with the cleaning composition of the invention may be suitably selected according to the concentrations of components constituting the cleaning composition, proportions of components, kind of flux to be removed and the like. Generally, the cleaning composition of the invention is brought into contact with the flux under the conditions of effective temperature and time required for removing the flux. The cleaning composition is used at a temperature of about 20 to about 80° C. If the temperature is lower than 20° C., the flux is dissolved in a less degree. On the other hand, the temperature of higher than 80° C. improves the detergency but vaporizes the water more rapidly, whereby ignition becomes likely to occur and control of safety becomes difficult. Usually, a preferred temperature is about 50 to about 70° C. For removal of solder flux on an electronic part by an immersion method at a temperature of, e.g. about 60° C., the solder flux can be sufficiently removed from the electronic part by immersion of electronic part in the cleaning composition of the invention for about 1 to about 20 minutes, generally.

After removal of solder flux, the electronic part may be subjected to, as a finishing treatment, a water-rinsing treatment (a pre-rinsing treatment and a finish-rinsing treatment) to remove the potentially remaining cleaning composition substantially or completely. Such rinsing treatment significantly enhances the cleanliness of the substrate.

11) Effects of the Invention

The invention can achieve the following effects.

11-1) The cleaning composition of the invention shows such high detergency that a high degree of cleaning can be attained.

11-2) The cleaning composition of the invention shows remarkable detergency when it is used in cleaning a flip chip device by removing a flux containing large amounts of a thixotropic agent and a thickener.

11-3) High degrees of degreasing and cleaning can be accomplished by the cleaning composition of the invention in the form of even a dilute solution containing the effective ingredients (the compound (A) and the nonionic surfactant (B)) in a concentration of about 1% by weight.

11-4) The cleaning composition of the invention which is halogen-free poses no problem on the destruction of ozone layer unlike freon detergent. The cleaning composition of the invention is satisfactory also in other respects such as environmental destruction, flammability, rinsability and odor.

EXAMPLES

The present invention will be described below in more detail with reference to the following examples to which, however, the invention is not limited.

Example 1

A cleaning composition was prepared by mixing together the following components in the proportions described below:

Compound (A); 1,3-dimethylimidazolidinone (82% by weight)

Surfactant (B); polyethylene glycol alkyl ether type nonionic surfactant (manufactured by Dai-ichi Kogyo Seiyaku Co., Ltd., trade name "NOIGEN ET-135", $R_3$ in the formula (2) is a branched-chain alkyl group of 12 to 14 carbon atoms and m is 9) (10% by weight)

Surfactant (C); phosphoric monoester of polyoxyethylenealkyl ether ($R_4$ in the formula (3) is a straight-chain alkyl group of 12 carbon atoms, n is 16 and X is a hydroxyl group) (2% by weight)

Compound (E); polyoxyethylenealkylamine ($R_6$ in the formula (5) is a straight-chain alkyl group of 12 carbon atoms, p+q=10 and Y is a hydrogen atom) (3% by weight)

Pure water; (3% by weight)

Examples 2 to 9 and Comparative Example

The cleaning compositions of Examples 2 to 9 and Comparative Example were prepared in the same manner as in Example 1 with the exception of replacing the components shown in Table 1.

TABLE 1

| | Kind of Components | | | | | Proportion (wt. %) | | | | | |
|---|---|---|---|---|---|---|---|---|---|---|---|
| | A | B | C | D | E | A | B | C | D | E | Water |
| Ex. 1 | a1 | b1 | c1 | d1 | — | 82 | 10 | 2 | 3 | 0 | 3 |
| Ex. 2 | a1 | b1 | c1 | d1 | — | 70 | 20 | 2 | 3 | 0 | 5 |
| Ex. 3 | a1 | b2 | c1 | d2 | — | 82 | 10 | 2 | 3 | 0 | 3 |
| Ex. 4 | a1 | b2 | c1 | d2 | — | 70 | 20 | 2 | 3 | 0 | 5 |
| Ex. 5 | a2 | b2 | c2 | d3 | — | 82 | 10 | 2 | 3 | 0 | 3 |
| Ex. 6 | a2 | b2 | c2 | d3 | — | 70 | 20 | 2 | 3 | 0 | 5 |
| Ex. 7 | a1 | b1 | c1 | d1 | — | 82 | 13 | 0 | 0 | 0 | 5 |
| Ex. 8 | a1 | b1 | c1 | d1 | — | 72 | 23 | 0 | 0 | 0 | 5 |
| Ex. 9 | a1 | b1 | c1 | d1 | e1 | 41 | 10 | 2 | 3 | 41 | 3 |
| Com. Ex. 1 | a' | b1 | c1 | d1 | — | 82 | 10 | 2 | 3 | 0 | 3 |

The following abbreviations in Table 1 represent the compounds described below:

a1: 1,3-dimethylimidazolidinone a2: 1,3-dipropylimidazolidinone b1: polyethylene glycol alkylether nonionic surfactant (manufactured by Dai-ichi Kogyo Seiyaku Co., Ltd., trade name "NOIGEN ET-135", $R_3$ in the formula (2) is a branched-chain alkyl group of 12 to 14 carbon atoms and m is 9)

b2: polyethylene glycol aralkylether type nonionic surfactant (manufactured by Dai-ichi Kogyo Seiyaku Co., Ltd., trade name "NOIGEN EA-120", $R_3$ in the formula (2) is a nonyl phenyl group and m is 5)

b3: polyoxyethylene sorbitan monolaurate (manufactured by Dai-ichi Kogyo Seiyaku Co., Ltd., trade name "SORGEN TW20", ethylene oxide, average added mole number 12)

c1: phosphoric monoester of polyoxyethylenealkyl ether ($R_4$ in the formula (3) is a straight-chain alkyl group of 12 carbon atoms, n is 16 and X is a hydroxyl group)

c2: phosphoric diester of polyoxyethylenearalkyl ether ($R_4$ in the formula (3) is a nonyl phenyl group, n is 10, X in the formula (5) is a nonyl phenyl group and n is 10)

d1: polyoxyethylenealkylamine ($R_6$ in the formula (5) is a straight-chain alkyl group of 12 carbon atoms, The sum of p and q is 10, and Y is a hydrogen atom)

d2: polyoxyethylenealkylamine ($R_6$ in the formula (5) is a straight-chain alkyl group of 18 carbon atoms, The sum of p and q is 7, and Y is a hydrogen atom)

d3: polyoxyethylene beef tallow amine ($R_6$ in the formula (5) is a residue of beef tallow comprising a mixture of oleic acid, linoleic acid, myristic acid, palmitic acid and stearic acid, The sum of p and q is 15, and Y is a hydrogen atom)

e1: benzyl alcohol a': diethylene glycol monobutyl ether

The cleaning compositions prepared in Examples 1 to 9 and Comparative Example were subjected to the following tests.

Flip chip devices in (i), (ii) and (iii) of Table 2 for use in testing were produced using the fluxes defined below Table 2 by the "method of mounting solder balls" described in Table 2.

TABLE 2

| | Method of mounting solder balls | Flux | | |
|---|---|---|---|---|
| | | Solvent | Thickener Thixotropic Agent | Viscosity |
| (i) | Solder balls coated with flux were transferred to IC chips. | Little | Much | High |
| (ii) | Solder paste was screen-printed on the substrate and then solder balls were transferred to the printed portion. | Little | Much | High |
| (iii) | After printing the solder, the solder was melted. | Little | Much | High |

(i) Trial product of flux (manufactured by Kyushu Matsushita Electric Co., Ltd.) for flip chip binding;

(ii) Trial product of flux (manufactured by TAMURA KAKEN CORPORATION) for flip chip binding; and (iii) Trial product of flux (manufactured by SENJU METAL INDUSTRY Co., Ltd.) for flip chip binding.

(1) Detergency

The substrates for use in (i), (ii) and (iii) of Table 2 were immersed in the cleaning composition at 70° C. for 10 minutes, and the degree of removal of flux was visually evaluated according to the following criteria.

A: Sufficiently removed

B: A little remaining

C: Considerably remaining

The results are shown in Table 3.

(2) Cleanliness

The substrate tested for detergency was washed with water and dried and the cleanliness (amount of remaining ions) of the substrate was measured by ion chromatography IC7000 (manufactured by YOKOGAWA Co., Ltd.). The results are shown in Table 3.

(3) Corrosiveness

An aqueous solution of the cleaning composition in a concentration of 5% by weight was prepared and was heated to 40° C. Then, each piece of nickel, zinc and lead was immersed in the solution for 1 hour. The change of metal surface before and after immersion was visually evaluated according to the following criteria.

A: No change

B: Metal surface tarnished.

C: Metal surface significantly rusted.

The results are shown in Table 3.

TABLE 3

| | Kind of flux | Detergency (residue) | Cleanliness amount of remaining Cl ($ng/cm^2$) | Corrosiveness | | |
|---|---|---|---|---|---|---|
| | | | | Nickel | Zinc | Lead |
| Example 1 | (i) | A | 1.1 | A | A | A |
| | (ii) | A | 2.2 | A | A | A |
| | (iii) | A | 2.0 | A | A | A |

TABLE 3-continued

| | Kind of flux | Detergency (residue) | Cleanliness amount of remaining Cl ($ng/cm^2$) | Corrosiveness | | |
|---|---|---|---|---|---|---|
| | | | | Nickel | Zinc | Lead |
| Example 2 | (i) | A | 0.2 | A | A | A |
| | (ii) | A | 1.1 | A | A | A |
| | (iii) | A | 0.8 | A | A | A |
| Example 3 | (i) | A | 2.5 | A | A | A |
| | (ii) | A | 4.4 | A | A | A |
| | (iii) | A | 4.2 | A | A | A |
| Example 4 | (i) | A | 1.0 | A | A | A |
| | (ii) | A | 2.5 | A | A | A |
| | (iii) | A | 2.4 | A | A | A |
| Example 5 | (i) | A | 3.8 | A | A | A |
| | (ii) | A | 5.1 | A | A | A |
| | (iii) | A | 4.6 | A | A | A |
| Example 6 | (i) | A | 2.3 | A | A | A |
| | (ii) | A | 3.6 | A | A | A |
| | (iii) | A | 3.2 | A | A | A |
| Example 7 | (i) | A | 1.4 | A | A | A |
| | (ii) | B | 2.9 | A | A | A |
| | (iii) | B | 2.9 | A | A | A |
| Example 8 | (i) | A | 0.6 | A | A | A |
| | (ii) | B | 1.9 | A | A | A |
| | (iii) | B | 2.1 | A | A | A |
| Example 9 | (i) | A | 0.8 | A | A | A |
| | (ii) | A | 1.2 | A | A | A |
| | (iii) | A | 1.3 | A | A | A |
| Com. Ex. 1 | (i) | C | 1.2 | A | A | A |
| | (ii) | C | 2.6 | A | A | A |
| | (iii) | C | 2.5 | A | A | A |

(4) Detergency of Dilute Solution

The cleaning compositions prepared in Examples 1 to 9 and Comparative Example were diluted with pure water to provide an aqueous solution containing the effective components (the compound (A) and the nonionic surfactant (B)) in a concentration of 1% by weight. The dilute solution was subjected to the following tests.

A terminal made of copper having a cutting oil adhering thereto (article A to be cleaned) or an electronic part made of ceramics having grease adhering thereto (article B to be cleaned) was set in a supersonic cleaning device (40 kHz, 600 W). The article A or B to be cleaned was cleaned with the dilute solutions in a concentration of 1% by weight (Examples 1 to 9 and Comparative Example) at 75° C. for 5 minutes. Then the article was rinsed with pure water for 5 minutes and was dried by hot air at 70° C. for 5 minutes. The degree of removal of oil (or grease) was visually evaluated according to the following criteria A: satisfactorily removed B: a little remaining C: markedly remaining.

The results are shown in Table 4.

TABLE 4

| | Kind of article to be cleaned | Detergency (residue) |
|---|---|---|
| Example 1 | A | A |
| | B | A |
| Example 2 | A | A |
| | B | A |
| Example 3 | A | A |
| | B | A |

TABLE 4-continued

| | Kind of article to be cleaned | Detergency (residue) |
|---|---|---|
| Example 4 | A | A |
| | B | A |
| Example 5 | A | A |
| | B | A |
| Example 6 | A | A |
| | B | A |
| Example 7 | A | A |
| | B | A |
| Example 8 | A | A |
| | B | A |
| Example 9 | A | A |
| | B | A |
| Comparative Example | A | B |
| | B | B |

INDUSTRIAL APPLICABILITY

The cleaning composition of the invention can be suitably used for removing solder flux, used in a flip chip devices, containing a thixotropic agent and a thickener in large amounts and for degreasing and cleaning metal parts and ceramic parts.

What is claimed is:

1. A cleaning composition comprising, as effective components, a compound (A) represented by the formula (1):

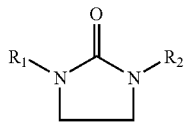

wherein $R_1$ represents a hydrogen atom or a straight-chain or branched-chain alkyl group having 1 to 5 carbon atoms and $R_2$ represents a hydrogen atom or a straight-chain or branched-chain alkyl group having 1 to 5 carbon atoms, and a nonionic surfactant (B), and a compound (E) represented by the formula (6)

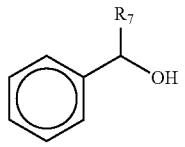

wherein $R_7$ represent a hydrogen atom or a straight-chain or branched-chain alkyl group having 1 to 5 carbon atoms.

2. A cleaning composition comprising a compound (A) represented by the formula (1), a nonionic surfactant (B), a polyoxyalkylenephosphoric ester surfactant (C) and a polyoxyalkyleneamine surfactant (D):

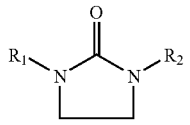

wherein $R_1$ represents a hydrogen atom or a straight-chain or branched-chain alkyl group having 1 to 5 carbon atoms and $R_2$ represents a hydrogen atom or a straight-chain or branched-chain alkyl group having 1 to 5 carbon atoms.

3. The cleaning composition according to claim 2, wherein the nonionic surfactant (B) is a polyethylene glycol ether type nonionic surfactant represented by the formula (2)

$$R_3—O—(CH_2—CH_2—O)_m—H$$

wherein $R_3$ represents a straight-chain or branched-chain alkyl group having 6 to 20 carbon atoms, a phenyl group or a phenyl group substituted with a straight-chain or branched-chain alkyl group having 7 to 12 carbon atoms and m represents an integer of 2 to 20.

4. The cleaning composition according to claim 2, wherein the polyoxyalkylenephosphoric ester surfactant (C) is a polyoxyethylenephosphoric ester surfactant represented by the formula (3) or a salt thereof:

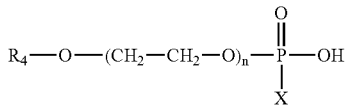

wherein $R_4$ represents a straight-chain or branched-chain alkyl group having 5 to 20 carbon atoms, a phenyl group or a phenyl group substituted with a straight-chain or branched-chain alkyl group having 7 to 12 carbon atoms, n represents an integer of 0 to 20 and X represents a hydroxyl group or a group represented by the formula (4)

$$R_5—O(CH_2—CH_2—O)_n—$$

wherein $R_5$ represents a straight-chain or branched-chain alkyl group having 5 to 20 carbon atoms, a phenyl group or a phenyl group substituted with a straight-chain or branched-chain alkyl group having 7 to 12 carbon atoms, and n represents an integer of 0 to 20.

5. The cleaning composition according to claim 2, wherein the polyoxyalkyleneamine surfactant (D) is a polyoxyethyleneamine surfactant represented by the formula (5)

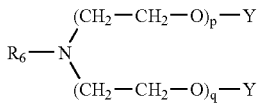

wherein $R_6$ represents a hydrogen atom, a straight-chain or branched-chain alkyl group having 1 to 22 carbon atoms or a straight-chain or branched-chain alkenyl group having 2 to 22 carbon atoms, Y represents a hydrogen atom or a straight-chain or branched-chain alkyl group having 1 to 4 carbon atoms or a straight-chain or branched-chain acyl group having 1 to 4 carbon atoms, p represents an integer of 1 to 15 and q represents an integer of 0 to 15.

6. The cleaning composition according to claim 2 which comprises 0.1 to 97% by weight of the compound (A), 0.1 to 97% by weight of the nonionic surfactant (B), 0.01 to 85% by weight of the polyoxyalkylenephosphoric ester surfactant (C) and 0.01 to 85% by weight of the polyoxyalkyleneamine surfactant (D).

7. The cleaning composition according to claim 2 which further contains a compound (E) represented by the formula (6)

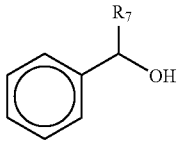

wherein $R_7$ represents a hydrogen atom or a straight-chain or branched-chain alkyl group having 1 to 5 carbon atoms.

8. The cleaning composition according to claim 2 which further contains water.

9. The cleaning composition according to claim 2 which is used for cleaning a flip chip devices.

10. A method of cleaning a flip chip device to be cleaned, the method comprising the step of bringing the cleaning composition of claim 1 into contact with the flip chip device to be cleaned.

11. A method of cleaning an article to be cleaned, the method comprising the step of bringing the cleaning solution of claim 2 into contact with the article to be cleaned.

* * * * *

UNITED STATES PATENT AND TRADEMARK OFFICE

CERTIFICATE OF CORRECTION

PATENT NO. : 7,018,964 B2
APPLICATION NO. : 10/240608
DATED : March 28, 2006
INVENTOR(S) : Maeno et al.

It is certified that error appears in the above-identified patent and that said Letters Patent is hereby corrected as shown below:

On Title Page, Item (54)

At the title, please delete "DETERGENT COMPOSITION" and insert therefore, --CLEANING COMPOSITION--.

At Column 10, Line 9, please delete "polyoxyalkenephophoric" and insert therefore, --polyoxyalkenephosphoric--.

At Column 11, Line 8, please delete "e.g." and insert therefore,--e.g.,--.

At Column 13, Line 34, please delete "removed" and insert therefore, --removed.--.

At Column 13, Line 35, please delete "remaining" and insert therefore, --remaining.--.

At Column 13, Line 36, please delete "remaining" and insert therefore, --remaining.--.

At Column 13, Line 52, please delete "change" and insert therefore, --change.--.

At Column 14, Line 51, please delete "criteria" and insert therefore, --criteria.--.

At Column 14, Line 52, please delete "removed" and insert therefore, --removed.--.

At Column 14, Line 53, please delete "remaining" and insert therefore, --remaining.--.

UNITED STATES PATENT AND TRADEMARK OFFICE

CERTIFICATE OF CORRECTION

PATENT NO. : 7,018,964 B2
APPLICATION NO. : 10/240608
DATED : March 28, 2006
INVENTOR(S) : Maeno et al.

It is certified that error appears in the above-identified patent and that said Letters Patent is hereby corrected as shown below:

At Column 15, Line 53 (Claim 1), please delete "represent" and insert

--represents--.

Signed and Sealed this

Fourteenth Day of November, 2006

JON W. DUDAS
*Director of the United States Patent and Trademark Office*